United States Patent [19]

Powell

[11] Patent Number: 4,895,305

[45] Date of Patent: Jan. 23, 1990

[54] OSCILLATING PISTON DRIVEN SPRINKLER

[76] Inventor: Jonathan S. Powell, 5094 Tip Top Rd., Mariposa, Calif. 95338

[21] Appl. No.: 274,338

[22] Filed: Nov. 21, 1988

[51] Int. Cl.[4] ..... B05B 3/16

[52] U.S. Cl. ..... 239/239; 91/224; 92/136

[58] Field of Search ..... 239/239, 237, 242; 74/109; 92/130 R, 136; 91/224, 229, 277, 321

[56] References Cited

U.S. PATENT DOCUMENTS

| | | | |
|---|---|---|---|
| 1,941,269 | 12/1933 | Phillips | 239/239 |
| 2,295,880 | 9/1942 | Valois et al. | 239/239 |
| 2,691,547 | 10/1954 | Campbell | 239/231 |
| 4,457,210 | 7/1984 | Pauliukonis | 92/136 |
| 4,509,686 | 4/1985 | Larsen | 239/239 |
| 4,527,465 | 7/1985 | Yoshida et al. | 92/136 |

*Primary Examiner*—Andres Kashnikow
*Assistant Examiner*—Christopher G. Trainor
*Attorney, Agent, or Firm*—Duane C. Bowen

[57] ABSTRACT

A sprinkler, connected to a water supply conduit, oscillates by the force of a piston moving in a cylinder and powered by water bleed in a bypass line from the water supply to the cylinder. The piston is connected to a rack which is engaged with a pinion that is attached to a sprinkler nozzle so that water is sprayed from the nozzle in an oscillating spray responsive to the reciprocation of the piston in the cylinder. A first compression spring is operative to return the piston to a home position after a power stroke. The piston has a discharge passageway covered by a valve piece on the pressure side of the piston. The valve piece is supported by a stem slidably disposed in a bore in the piston. A head is fitted to the opposite end of the stem and a tripper compression spring is aligned with the head so that as the piston expands the head compresses the tripper spring until the force of the tripper spring overcomes the water pressure holding the valve piece closed. Then the valve opens and water is discharged through the discharge passageway and the first compression spring returns the piston to the home position. An end of the head is wedged in a flared portion of the bore to hold the valve open until the piston reaches its home position whereupon the valve strikes the end wall of the cylinder and is brought back to position closing the discharge passageway. The tripper compression spring is supported on the end of a threaded rod and the arc of oscillation of the sprinkler is precisely adjusted in length by rotary adjustment of that threaded rod.

11 Claims, 2 Drawing Sheets

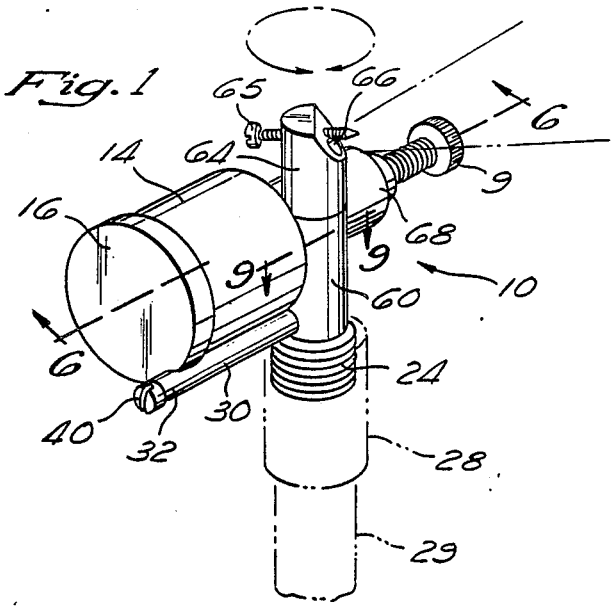
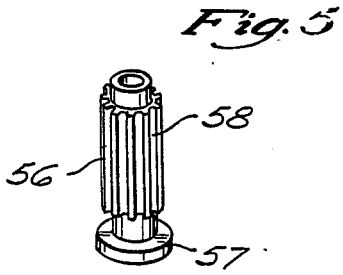
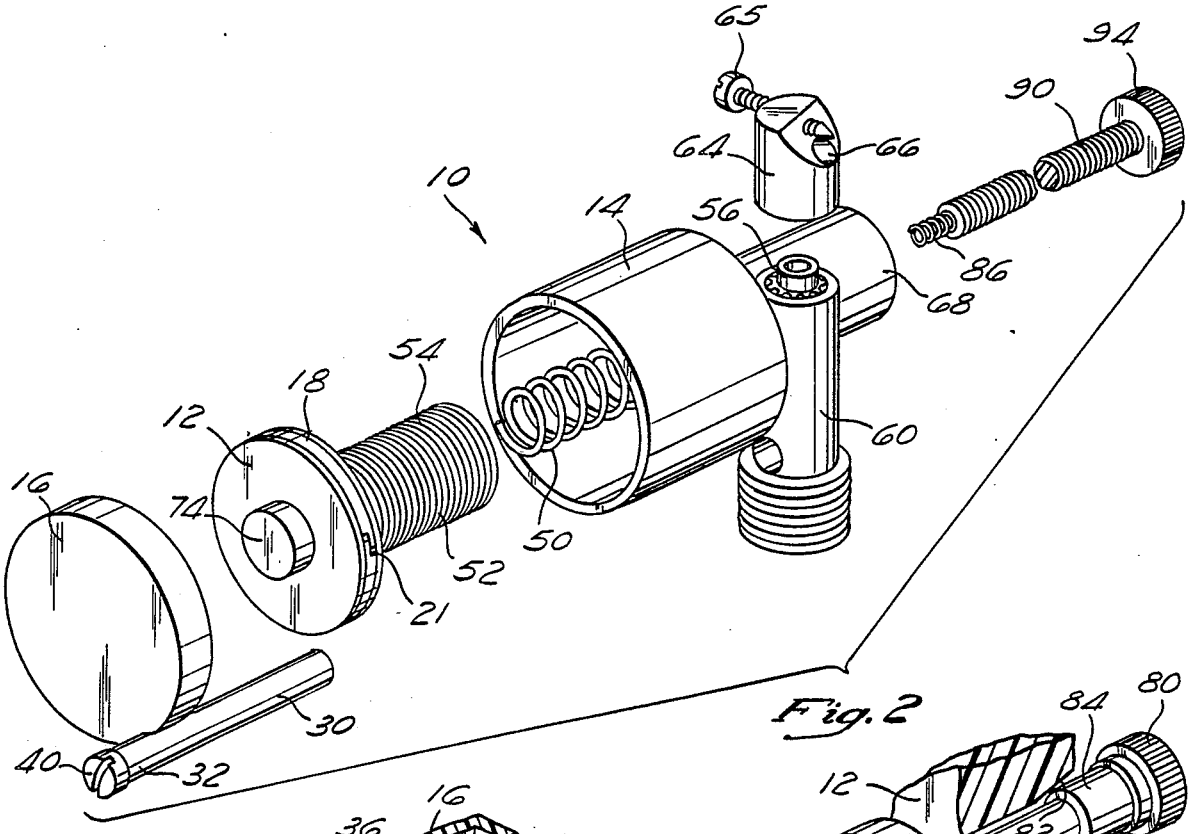
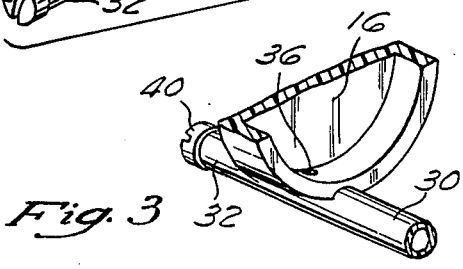
Fig. 3
Fig. 2
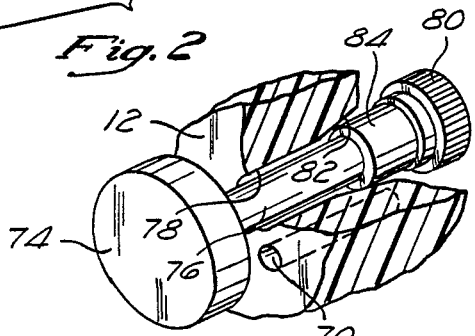
Fig. 4

OSCILLATING PISTON DRIVEN SPRINKLER

BRIEF SUMMARY OF THE INVENTION

Background and Objectives

My invention relates to an oscillating sprinkler driven by a piston.

Oscillating sprinklers have considerable use in the field of irrigation. One widely sold brand of oscillating sprinkler prior to my invention is called "RAIN BIRD". It is an objective of my invention to provide an improved oscillating sprinkler.

Desirable characteristics of an improved oscillating sprinkler include:

(1) Quiet operation.
(2) Operability at low water pressures and operability at slow speeds of oscillation.
(3) Economy by injection molded construction.
(4) Avoidance of splashback.
(5) Precise adjustability of angle of oscillation.
(6) Relatively slow movement in one direction and relatively rapid movement in the other direction so that water will have maximum throw in the first direction and minimum throw in the second direction to thereby give more uniform watering of all areas, inner and outer, covered by the sprinkler.
(7) Variability in size, such as smaller unit for small yard and larger unit for agricultural or golf course irrigation.

It is an objective of my invention to devise an oscillating sprinkler design with the above characteristics.

Further objectives of my invention include: to power an oscillating sprinkler by a piston and cylinder; and to provide reliability of operation, low maintenance and long life in an oscillating sprinkler design.

My invention will be best understood, together with additional advantages and objectives thereof, when read with reference to the drawings.

DRAWINGS

FIG. 1 is a perspective view of a specific embodiment of my new sprinkler. A pipe and a union are indicated in dashed lines.

FIG. 2 is a perspective view in exploded form.

FIG. 3 is a partial view of bleed water details, rendered in perspective and partly in section.

FIG. 4 is a partial view of valve details, rendered in perspective and partly in section.

FIG. 5 is a perspective view of a pinion.

DESCRIPTION

Figure 6:
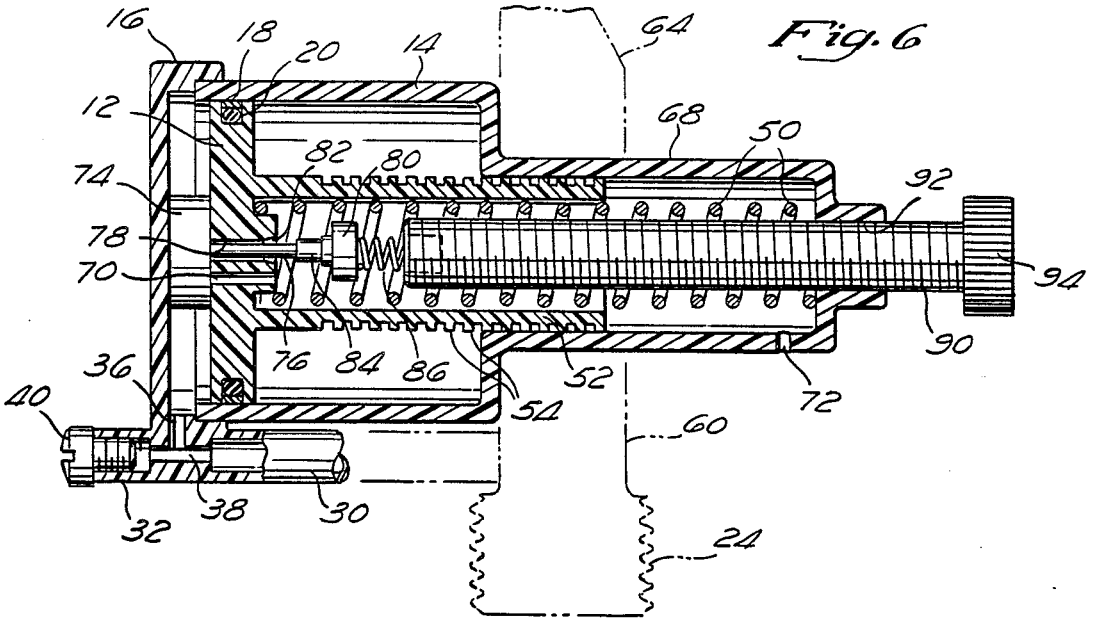
FIG. 6 is a view, partly in section, taken on line 6—6 of FIG. 1. The valve is in closed position and the piston is fully retracted.
Figure 7:
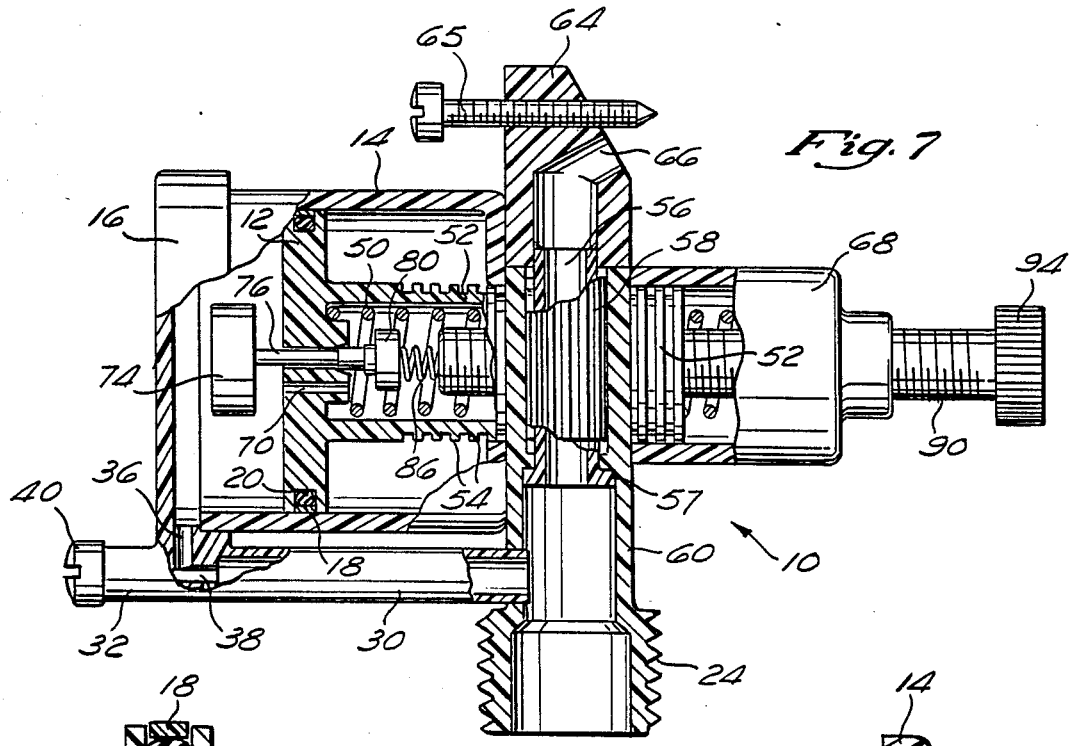
FIG. 7 is a view generally similar to FIG. 6 but the valve is in open position and the piston is in the process of returning to the FIG. 6 position.
Figure 8:
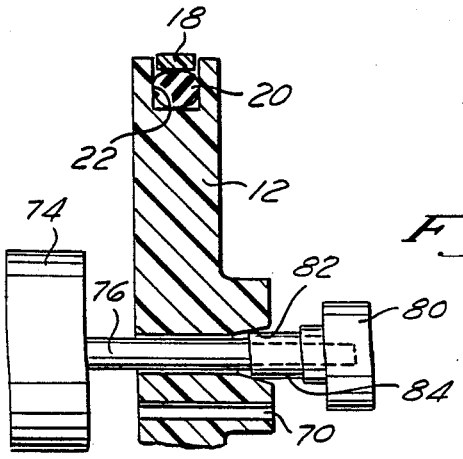
FIG. 8 is an enlarged view, partly in section, concerning valve details.
Figure 9:
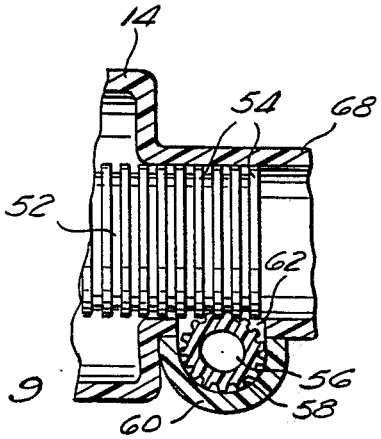
FIG. 9 is a view partly in section showing rack and pinion engagement. The view is taken generally on line 9—9 of FIG. 1.

Powering of oscillation in my sprinkler 10 is achieved through a piston 12 slidably mounted in a cylinder 14. Most of the parts of my sprinkler will be injection molded from a plastic, preferably ABS. Cylinder 14 has an end closed by a cap 16 cemented in place and the water chamber in sprinkler 10 is the space in cylinder 14 between piston 12 and end wall 16. The seal of piston 12 is accomplished by a Teflon flat ring 18 backed up by a rubber 0-ring 20 to squeeze ring 18. Rings 18, 20 are set in an edge groove 22 in piston 12. This construction has low friction and wear but seals adequately for water at a maximum of tap water pressures per square inch. In economy models, however, a rubber O-ring 20 may be an adequate seal by itself. Teflon ring 18 is split by a stepped or angled cut 21 so that ring 18 can reduce in diameter other than by compression, such as to adjust in diameter responsive to draft in cylinder 14 due to molding requirements.

Water inlets to sprinkler 10 through a fitting 24 having a male threaded bushing section, to connect to a union 28 or the like connecting to a source of water represented by pipe 29. A by-pass bleed tube 30 connects to the water inlet housing 60. Tube 30 has one end 32 bonded to cap 16 or is molded as a part of cap 16. A port 36 extends through the wall of tube 30 and cap 16 to inlet water into cylinder 14. Tube 30 meters water to cylinder 14 at a rate determined by water pressure and the size of bleed orifice 38 in tube 30. End 32 of tube 30 is closed by a screw 40. Orifice 38 can be cleaned of foreign material by access through end 32 of tube 30 upon removal of screw 40. Removal of deposits from water in orifice 38 is important to the life of sprinkler 10, assuming that orifice 38 is the smallest water passageway in the sprinkler. An adjustable bleed orifice could be provided if desired.

Piston 12 is pressed toward the closed end wall 16 of cylinder 14 by a compression spring 50. An annular extension 52 is made on the opposite side of piston 12 from end wall 16. Extension 52 has a multiplicity of annular ribs 54 forming teeth along its length whereby extension 52 forms a rack. A pinion 56 is provided having teeth 58 engaged with teeth 54 on rack 52. Teeth 58 are formed by ribs extending parallel to the axis of rotation of pinion 56. Pinion 56 rotates as piston 12 moves in cylinder 14. Pinion 56 is housed and rotatably supported in a vertically disposed housing 60 on the side of cylinder 14. An end flange 57 at one end of pinion 56 and nozzle 64 at the other end bonded to pinion 56 hold pinion 56 from shifting axially of housing 60. An opening 62 through housing 60 and cylinder 14 permits pinion 56 to engage with rack 52. Fitting 24 connects to or forms a part of the lower end of housing 60.

Attached to the upper end of the hollow pinion 56 is a nozzle 64 having a discharge orifice 66 with an axis directed upwardly and to the side preferably at an angle of about 30° to the horizontal. The stream of water ejecting from nozzle 64 will pivot as pinion 56 rotates. Water passes from fitting 24 upwardly through the hollow pinion 56 to nozzle 64. A screw 65 is supported on nozzle 64 and has an end extending into the path of the stream of water ejecting from discharge orifice 66. Screw 65 is rotatably adjustable so that its end extends into the path of the stream of water to a greater or lesser extent to more or less spread the stream and to lengthen or reduce throw of the stream.

The housing forming cylinder 14 has a reduced diameter portion 68 at the opposite end from cap 16. The inner annular wall of reduced diameter portion 68 forms a guide for rack 52 as it reciprocates.

Piston 12 has a discharge passageway 70 therethrough. When discharge passageway 70 is open, water from the pressure side of piston 12 can discharge through passageway 70 to the other side of piston 12 whereby piston 12 will be returned to a position adjacent cap 16 by force from spring 50. Water passing to the non-pressure side of piston 12 can discharge from the cylinder housing through an exit port 72. A valve piece 74 is disposed to cover and seal discharge passageway 70.

The general cycle of the sprinkler is as follows: Water upstream of sprinkler nozzle 64 passes through a capillary by-pass tube 30 into cylinder 14 to power the reciprocating piston 12. On the power stroke, piston 12 is moved to the end of its power stroke (which can be readily adjusted in distance, as hereafter described), valve piece 74 opens, pressurized water exhausts through passageway 70, and piston 12 is returned to its home position by compression spring 50. The valve piece 74 closes and the cycle repeats. Sprinkler nozzle 64 rotates in one direction on the power stroke and sprinkler nozzle 64 rotates in the opposite direction when spring 50 returns piston 12. Rotating motion is translated from piston 12 to nozzle 64 by rack 52 and pinion 56. The rotation of the nozzle by the power stroke of the piston can be very slow by having a very small water feed rate to get maximum throw of the water, speed being determined by tap pressure, the size of bleed orifice, and other dimensions. The spring return rotation can be very fast to get less throw of the water for intermediate watering, the speed of return being partly a function of the size of discharge passageway 70.

A critical and novel part of my sprinkler involves obtaining reciprocating motion of piston 12. Many hours of trial and error experimentation went into finding the solution to this requirement. The key is the valve design. Valve 74 has to be free to move without any resistance just before it closes upon the return stroke of piston 12. The hydraulic effect of the flowing water then closes valve 74 the rest of the way and keeps it closed.

Valve 74 is supported by a valve stem 76 that is loosely fitted in a bore 78 in piston 12. It will be seen that valve 74 is supported by stem 76 to cover and seal discharge passageway 70 in the closed position of valve piece 74. Valve stem 76 has a head or foot 80 that is press fitted on the end of stem 76. Head member 80 is preferably formed of Teflon. The end of bore 78 in piston 14 opposite to the closed cylinder wall 16 is flared at 82 and the adjacent end 84 of head 80 is sized to wedge into the flare 82 of passageway 80 to hold the valve piece 74 by friction until it strikes the end cap 16 and end 84 of head 80 is released from being wedged into the flared portion 82 of bore 78. When valve piece 84 first opens, it needs to be held in open position by end 84 of head 80 being wedged into flare 82 of bore 78 or else water ejecting into cylinder 14 would tend to prematurely close valve piece 74 upon the commencement of return of piston 12 by compression spring 50. The valve would essentially chatter in a cycle opening and closing rapidly.

The end of head or foot 80 contacts a second compression spring 86 aligned with bore 78. As piston 12 moves in its power stroke it sooner or later contacts spring 86. Head 80 stores more and more energy in spring 86 until finally the force of the energy stored in spring 86 exceeds the force of the water pressure in cylinder 14 holding valve piece 74 shut, whereupon valve piece 74 opens, end 84 of head 10 frictionally wedges in the flared portion 82 of discharge passageway 70, and piston 12 returns home.

Second compression spring 86 fits on the end of a piston stroke adjustment screw 90. It is threadedly engaged in a threaded opening 92 in the end of the reduced diameter portion 68 of the cylinder housing. Screw 90 has a knurled end 94 and is readily manually adjusted to vary the length of the power stroke piston 12 and rack 52 and thereby to precisely fix the length of the arc of oscillation of the sprinkler.

A novel element of the system of oscillating piston 12 in cylinder 14 is the valving design which makes the oscillation of the piston possible. The following is an explanation of the valve operation:

Let:

D=diameter of cylinder 14 d=diameter of valve head 74

T=force in lbs. of return spring 50

F=force from water pressure keeping valve closed

Then:

$$F = Tx\frac{d^2}{D^2}$$

The bleed water flow moves the piston 12 until the valve stem head 80 contacts the compression tripper spring 86 and continues to move and compress this spring until the force of this spring equals F. The valve 74 then begins to open and the piston 12 stops moving and the force holding the valve 74 closed drops rapidly from water leaking under it. The energy stored in the tripper spring 86 is released forcing the valve fully open (without any piston movement required). The valve 86 is held open by the tripper spring forcing the friction portion 84 of head 80 into flared socket 82. (If this didn't happen the valve 74 would close again as the piston 12 moved away from the tripper spring 86 because of the flow of water past the valve head through the port 70.)

When the piston 12 is moved to the end of the cylinder by the return spring 50, the valve head 74 contacts the end 16 of the cylinder and forces the friction portion 84 out of its socket 82 and the valve 74 closes to repeat the cycle.

I claim:

1. An oscillating sprinkler to connect at its upstream end to a water supply conduit, comprising:

(a) a sprinkler body having a cylinder with a closed end and a piston disposed in said cylinder operative to move toward and away from the closed cylinder end and a first compression spring urging said piston toward said closed cylinder end, (b) a sprinkler nozzle to receive water from said conduit and supported on said sprinkler body to pivot about an upright axis, rack means operated by said piston and pinion means on said nozzle engaged with said rack means so that said nozzle rotates as said piston moves, said nozzle having an orifice adapted to direct water in a stream directed radially relative to the axis of pivoting of said nozzle, said stream pivoting as said nozzle pivots, (c) said sprinkler body having a water inlet port to said cylinder and a bypass passageway connecting said upstream end of said sprinkler to said inlet port to bleed water thereto, and (d) said piston having a water discharge passageway therethrough, a valve piece operable to close said discharge passageway disposed on the side of the piston toward said closed cylinder end, said piston having a bore and a valve stem secured to said valve piece and slidably disposed in said bore guiding said valve piece in movement from an open position away from said piston to a closed position closing said water discharge passageway, a valve foot at the opposite end of said stem from said valve piece, said sprinkler body supporting a second compression spring aligned with the axis of said stem facing said valve foot and pressing said valve foot with enough pressure to move said valve piece from said closed to said open position overcoming water pressure on said valve piece resisting opening when said piston has moved a selected distance from said closed end of said cylinder, said piston being returned to said closed end of said cylinder when said valve piece is moved to said open position.

2. The sprinkler of claim 1 in which said valve foot has a portion wedging in said bore to secure said valve piece in said open position when said valve piece originally moves to said open position.

3. The sprinkler of claim 1 in which said second compression spring is supported on a rod that is threaded and can be adjusted to various distances from said closed end of said cylinder whereby said piston will travel different distances before the pressure of said second compression spring moves said valve piece to said open position, thereby varying the arc of pivoting of said nozzle.

4. A sprinkler to connect at its upstream end to a water supply conduit, comprising:

(a) a sprinkler body having a cylinder with a closed end and a piston disposed in said cylinder operative to move toward and away from said closed end of said cylinder and a first compression spring urging said piston toward said closed cylinder end, (b) a sprinkler nozzle to receive water from said conduit, said nozzle being supported on said sprinkler body to pivot about a vertical axis and said nozzle having a portion forming a pinion, and said piston having a rack engaged with said pinion so that said nozzle pivots as said piston moves, said nozzle being operative to direct water in a stream extending radially relative to the pivotal axis of said nozzle, said stream pivoting as said nozzle pivots, (c) said sprinkler body having a water inlet port to said cylinder and water by-pass means to fluidly connect said port with said conduit to bleed water to said port, and (d) said piston having a water discharge passageway therethrough, a valve piece operable to close said discharge passageway disposed on the side of said piston toward said closed cylinder end, said piston having a central bore and a valve stem secured to said valve piece and slidably disposed in said bore guiding said valve piece in movement from an open position away from said piston to a closed position closing said water discharge passageway, said sprinkler body supporting a second compression spring aligned with the axis of said stem and facing said stem, said second compression spring abutting said valve stem when said piston has traveled far enough from said closed end of said cylinder to be compressed until sufficient force is stored in said second compression spring to overbalance water pressure on said valve piece and thereby to move said valve piece from said closed position to said open position whereby water pressure in said cylinder can escape through said water discharge passageway and said piston can be moved toward said closed end of said cylinder under the force of said first compression spring.

5. The sprinkler of claim 4 in which there is latch means securing said valve piece in said open position when it is brought to said open position by the force of said second compression spring.

6. The sprinkler of claim 5 in which said latch means includes a resilient member connected to said valve stem that wedges in said bore.

7. The sprinkler of claim 4 in which said second compression spring is supported on a rod that is threaded and can be adjusted to various distances from said closed end of said cylinder whereby said piston will travel different distances before the pressure of said second compression spring moves said valve piece to said open position, thereby varying the arc of pivoting of said nozzle.

8. A sprinkler to connect at its upstream end to a water supply conduit, comprising:

(a) a sprinkler body having a cylinder with a closed end and a piston disposed in said cylinder operative to move toward and away from said closed end of said cylinder and a compression spring urging said piston toward said closed cylinder end, (b) a sprinkler nozzle to receive water from said conduit, said nozzle being supported on said sprinkler body to pivot about a vertical axis and said nozzle having a portion forming a pinion, and said piston having a rack engaged with said pinion so that said nozzle pivots as said piston moves, said nozzle being operative to direct water in a stream extending radially relative to the pivotal axis of said nozzle, said stream pivoting as said nozzle pivots, (c) said sprinkler body having a water inlet port to said cylinder and water by-pass means to fluidly connect said port with said conduit to bleed water to said port, (d) valve means operative to release water pressure from the space between said piston and said closed end of said cylinder when said piston has moved a selected distance away from said closed end of said cylinder, whereby said compression spring can move said piston back toward said closed end of said piston (e) said cylinder having a larger diameter portion adjacent to said closed end of said cylinder in which said piston reciprocates and said cylinder having a smaller diameter annular portion opposite from said closed end of said cylinder and said rack being an annular reduced diameter portion of said piston extending into and fitting and guided by said smaller diameter annular portion of said cylinder, and (f) said valve means including said piston having a water discharge passageway therethrough, a valve piece operable to close said discharge passageway disposed on the side of said piston toward said closed end of said cylinder, said piston having a bore and a valve stem secured to said valve piece and slidably disposed in said bore guiding said valve piece in movement from an open position away from said piston to a closed position closing said water discharge passageway, a valve foot at the opposite end of said stem from said valve piece, a second compression spring located within said annular portion of said piston aligned with the axis of said stem facing said valve foot and pressing said valve foot with enough pressure to move said valve piece from said closed position to said open position overcoming water pressure on said valve piece resisting opening when said piston has moved a selected distance from said closed end of said cylinder, said piston being returned to said closed end of said cylinder when said valve piece is moved to said open position.

9. The sprinkler of claim 8 in which said valve foot has a portion wedging in said bore to secure said valve piece in said open position when said valve piece originally moves to said open position.

10. The sprinkler of claim 9 in which said second compression spring is supported on a rod that is threaded and can be adjusted to various distances from said closed end of said cylinder whereby said piston will travel different distances before the pressure of said second compression spring moves said valve piece to said open position, thereby varying the arc of pivoting of said nozzle, said rod being disposed at least partly within said annular portion of said piston, the end of said smaller diameter annular portion of said cylinder having a threaded opening in which said rod is threadedly engaged.

11. A sprinkler to connect at its upstream end to a water supply conduit, comprising:

(a) a sprinkler body having a cylinder with a closed end and a piston disposed in said cylinder operative to move toward and away from said closed end of said cylinder and a first compression spring urging said piston toward said closed cylinder end, (b) a sprinkler nozzle to receive water from said conduit, said nozzle being supported on said sprinkler body to pivot about an axis and said nozzle having means connected thereto forming a pinion, and said piston having means connected thereto forming a rack engaged with said pinion so that said nozzle pivots as said piston moves, said nozzle being operative to direct water in a stream extending radially relative to the pivotal axis of said nozzle, said stream pivoting as said nozzle pivots, (c) said sprinkler body having a water inlet port to said cylinder and water by-pass means to fluidly connect said port with said conduit to bleed water to said port, and (d) said piston having a water discharge passageway therethrough, a valve piece operable to close said discharge passageway disposed on the side of said piston toward said closed cylinder end, said piston having a central bore and a valve stem secured to said valve piece and slidably disposed in said bore guiding said valve piece in movement from an open position away from said piston to a closed position closing said water discharge passageway, said sprinkler body supporting a second compression spring aligned with the axis of said stem and facing said stem, said second compression spring abutting said valve stem when said piston has traveled far enough from said closed end of said cylinder to be compressed until sufficient force is stored in said second compression spring to overbalance water pressure on said valve piece and thereby to move said valve piece from said closed position to said open position whereby water pressure in said cylinder can escape through said water discharge passageway and said piston can be moved toward said closed end of said cylinder under the force of said first compression spring.

* * * * *